US007189122B2

(12) United States Patent
Freitag

(10) Patent No.: US 7,189,122 B2
(45) Date of Patent: Mar. 13, 2007

(54) HAND LEVER BATTERY TERMINAL CONNECTOR

(75) Inventor: Erik Freitag, Arlington Heights, IL (US)

(73) Assignee: Royal Die & Stamping Co., Inc., Bensenville, IL (US)

( * ) Notice: Subject to any disclaimer, the term of this patent is extended or adjusted under 35 U.S.C. 154(b) by 0 days.

(21) Appl. No.: 11/073,878

(22) Filed: Mar. 7, 2005

(65) Prior Publication Data

US 2006/0199442 A1 Sep. 7, 2006

(51) Int. Cl.
*H01R 4/50* (2006.01)

(52) U.S. Cl. ..... 439/773

(58) Field of Classification Search ..... 439/773, 439/759–765, 761, 762
See application file for complete search history.

(56) References Cited

U.S. PATENT DOCUMENTS

| | | | | | |
|---|---|---|---|---|---|
| 1,596,891 | A | | 8/1926 | Rensch | |
| 1,803,718 | A | | 5/1931 | McClellan | |
| 1,977,179 | A | * | 10/1934 | Fisch | 439/761 |
| 2,271,692 | A | | 2/1942 | Hewel | |
| 2,706,284 | A | | 4/1955 | Hoggatt et al. | |
| 2,769,964 | A | | 11/1956 | Lartz | |
| 3,529,281 | A | * | 9/1970 | Martinez et al. | 439/726 |
| 3,568,138 | A | | 3/1971 | Bakker | |
| 4,054,355 | A | | 10/1977 | Kourimsky et al. | |
| 4,063,794 | A | | 12/1977 | Dittmann | |
| 4,354,726 | A | | 10/1982 | Kato et al. | |
| 4,964,819 | A | * | 10/1990 | Caraballo | 439/773 |
| 4,983,086 | A | * | 1/1991 | Hatrock | 411/259 |
| 5,254,020 | A | | 10/1993 | Obligar | |
| 5,269,709 | A | | 12/1993 | Eriksson | |
| 5,316,505 | A | | 5/1994 | Kipp | |
| D363,699 | S | * | 10/1995 | Mountfort | D13/120 |
| 5,595,510 | A | | 1/1997 | Obligar | |
| 5,599,210 | A | | 2/1997 | Green | |
| 5,616,055 | A | | 4/1997 | Heeren | |
| 5,672,442 | A | | 9/1997 | Burnett | |
| 5,711,688 | A | | 1/1998 | Matsunaga et al. | |
| 5,733,152 | A | | 3/1998 | Freitag | |
| 5,738,552 | A | | 4/1998 | Halbach et al. | |
| 5,800,219 | A | | 9/1998 | Siedlik et al. | |
| 5,879,202 | A | | 3/1999 | Zhao | |

(Continued)

FOREIGN PATENT DOCUMENTS

| | | |
|---|---|---|
| EP | 0 374 342 | 6/1990 |

OTHER PUBLICATIONS

International Search Report for PCT/US2006/001807 dated May 29, 2006.

*Primary Examiner*—Alexander Gilman
(74) *Attorney, Agent, or Firm*—McDermott Will & Emery LLP

(57) ABSTRACT

A battery terminal connector, especially for securement to the battery terminal post of an electrical storage battery. The battery terminal connector includes at least a body portion, a generally circular opening within that body portion for receiving the battery terminal post, and a horizontal bar extending transversely along the body portion. The connector further includes a movable lever for effecting two-way lateral movement of that horizontal bar. Lateral movement of the horizontal bar in one direction effects the opening of the generally circular opening, and lateral movement of the horizontal bar in a second direction effects the closing of the generally circular opening.

15 Claims, 2 Drawing Sheets

U.S. PATENT DOCUMENTS 5,941,738 A 8/1999 Matsunaga et al.
6,174,207 B1 1/2001 Cleveland
6,250,973 B1 6/2001 Lowery et al.

* cited by examiner

HAND LEVER BATTERY TERMINAL CONNECTOR

TECHNICAL FIELD

The invention relates to a battery terminal connector. In particular, this invention relates to a battery terminal connector that can be attached to a battery terminal without the use of tools, including wrenches, screwdrivers, or pry-bars.

BACKGROUND OF THE INVENTION

Storage batteries of the type used in automobiles, trucks, and other motor vehicles generally have a terminal post made of a lead alloy or other conductive material. These terminal posts are of a generally cylindrical or frusto-conical shape. The battery is connected to the components of the vehicle's electrical system with a battery cable assembly. The cable assembly has connectors which clamp to the battery posts, providing a secure electrical and mechanical connection.

A conventional connector for connecting cables to the battery may be a molded, generally U-shaped device with a bolt passing through outwardly projecting yoke-like arms. These connectors are securely clamped to the battery terminal post.

Alternatively, the connector may be a stamped metal battery terminal connector, fabricated from a flat sheet of copper or another conductive metal.

In either event, the bolt passing through the yoke-like arms is associated with a nut. When the nut is tightened on the bolt, the yoke-like arms move towards each other. The perimeter of a opening or hole defined by those arms is thereby reduced in size, and thus tightly grips the battery terminal post. In contrast, when the nut is loosened on the bolt, the yoke-like arms move away from each other, loosening the grip of the battery terminal connector on the battery terminal posts. Under these loosened conditions, the battery terminal connector can be removed from the battery terminals.

U.S. Pat. No. 5,879,202 ("the '202 patent") is directed to one type of a battery terminal connector. This connector can be tightened onto the battery terminal post using a threaded nut that is positioned above, rather than on the side of, the connector. As a result, especially in tight, confining areas often found under the hoods of modern, smaller automobiles, the nut is more easily accessed during installation, as compared to the accessibility of the threaded nuts that are secured to the sides of many prior art connectors.

In the case of the '202 patent battery terminal connectors, or connectors generally similar to those described in the '202 patent, tools must be used to install or remove the battery terminal connectors.

Even when these battery terminal connectors are new, the yoke-arms are alternatively brought together and separated by applying a box end wrench to the bolt, and then turning that box end wrench. Typically, the nut is held securely in the battery terminal connector, and as a result resists rotation. Thus, no wrench needs to be applied to the nut.

Commonly, battery terminal connectors on a new car remain untouched during the first four to five years of the life of the automobile. Typically, the terminal connectors are first contacted only upon the discharge of the OEM battery, when that battery must be replaced, or when electrical maintenance or repairs are necessary.

In the four to five years in the hostile under-hood environment of an automobile, the battery terminal connectors are subjected to shock, vibration, dirt, moisture, corrosion-inducing salt spray from the roads, and temperature extremes ranging from perhaps −30 degrees Fahrenheit to 150 degrees Fahrenheit. As a result, the battery terminal connectors and the nut and bolt are often extremely corroded, and in some cases deformed.

When an automotive technician or the automobile owner attempts to loosen such damaged battery terminal connectors, the nut and bolt on the connector is often so corroded that the wrench "rounds" or deforms the nut, or the head of the bolt. Even if the nut and bolt can be turned and loosened by the wrench, the yoke-like arms often will not separate.

Under these circumstances, the technician or automobile owner must place a screwdriver or other thin-bladed implement in the narrow space between the yoke-like arms. The screwdriver is then rotated, so that the blade contacts and forcibly pushes the arms apart.

This will usually, but not always, permit the removal of the battery terminal connector from the battery terminal post. Sometimes, upward pressure must be applied by a screwdriver, a small pry-bar, or some other flat-bladed implement. Particularly, the screwdriver or pry-bar is inserted between the top of the battery case and the bottom of the battery terminal connector, and the connector is then pried away from the top of the battery case. This will usually move the battery terminal connector away from the battery case.

Thus, it would be desirable to provide a battery terminal connector that has integral structures, which integral structures can be used to facilitate the attachment of the battery terminal connector to the battery terminal post, without the use of tools. It would also be desirable to provide a battery terminal connector that has internal structures that can facilitate the loosening of the battery terminal connector from the battery terminal. Finally, it would be desirable to provide a battery terminal connector that can be opened to a great extent, i.e., to an extent greater than the minimal extent necessary to remove the connector from the battery terminal, so as to facilitate the removal of a corroded terminal connector from a battery terminal, without the need for tools.

Additional relevant prior art references include U.S. Pat. Nos. 6,250,973, 6,174,207; 5,941,738, 5,879,202, 5,800,219, 5,738,552, 5,733,152, 5,711,688, 5,672,442, 5,616,055; 5,599,210, 5,595,510; 5,316,505, 5,269,709; 5,254,020; 4,354,726, 4,063,794, 4,054,355, 3,568,138; 2,769,964; 2,706,284; 2,271,692; 1,803,718; and 1,596,891.

The present invention is provided to solve the problems discussed above and other problems, and to provide advantages and aspects not provided by prior art battery terminal connectors of this type. A full discussion of the features and advantages of the present invention is deferred to the following detailed description, which proceeds with reference to the accompanying drawings.

SUMMARY OF THE INVENTION

The invention is a battery terminal connector for securement to the battery terminal post of an electrical storage battery. The battery terminal connector includes at least a body portion, and a generally circular opening within that body portion. That generally circular opening receives, and is secured to, the battery terminal post of the electrical storage battery.

The body portion may also include an inner wall and an outer wall. A generally horizontal bar extends transversely along the body portion. Optionally, the horizontal bar may extend through slots in both the inner and outer wall.

The terminal connector further includes a movable lever for effecting two-way lateral movement of that horizontal bar. More particularly, lateral movement of the horizontal bar in one direction effects an opening or an increase in size of the generally circular opening. In contrast, lateral movement of the horizontal bar in a second direction effects the closing or decrease in size of the generally circular opening.

The lever may include an integral cam. Rotation of the lever rotates the cam. In turn, that cam rotates within an orifice disposed within the horizontal bar. As the lever is moved in clockwise or counterclockwise directions, that cam abuts against the perimeter of the orifice. As a result, movement of the lever in clockwise and counterclockwise directions, respectively, causes the horizontal bar to move in one of two opposite lateral directions.

The horizontal bar may include a head, preferably a generally perpendicular head. This head may be positioned adjacent to, and can abut against, the outer wall of the body portion. The generally perpendicular head imparts relatively even pressure upon that outer wall.

The battery terminal connector of the invention permits attachment of the connector onto the battery terminal post, and its removal from that battery terminal post, without the use of tools. The lever, in combination with the horizontal bar, facilitates the attachment of the connector without tools.

In the most preferred embodiment, the lever is movable into one of three positions. When the lever is moved into the first position, the generally circular opening of the battery terminal connector is relatively small, and thus abuts against and tightly grips the battery terminal post. When the lever is moved into the second position, the generally circular opening of the battery terminal connector increases in size, so that that opening becomes spaced a relatively small distance away from the battery terminal post. Finally, when the lever is moved into the third position, the opening increases in size even more, so that the opening is spaced a relatively large distance away from the battery terminal post.

An insulating cover may be placed over the lever of the battery terminal connector. This insulating cover reduces the possibility of shock, and reduces the possibility that electrical current could move from the battery to the lever, and then to an electrical ground. Thus, the insulating cover reduces the possibility that the battery may be accidentally discharged.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

This invention is susceptible of embodiments in many different forms. The drawings and the specification show in detail a preferred embodiment of the invention. This disclosure is to be considered as an example of the principles of the invention. The disclosure is not intended to limit the broad aspect of the invention to the illustrated embodiment.

Figure 1:
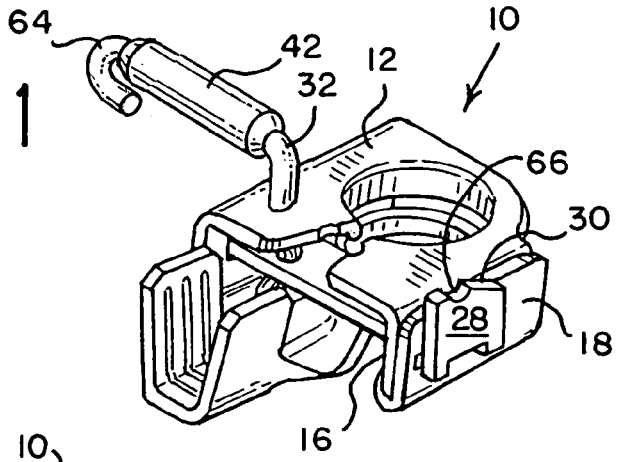
FIG. 1 is a perspective view of a preferred embodiment of the battery terminal connector in accordance with the invention.

Referring now to FIG. 1, the invention is a battery terminal connector 10. In many ways, the illustrated battery terminal connector 10 is conventional. For example, the battery terminal connector 10 includes a relatively common body portion 12 made of a conductive material, and preferably a conductive metal, including but not limited to copper or copper alloys.

Unlike many battery terminal connectors of the prior art, however, the body portion 12 of the present invention includes structures which permit the attachment of the terminal connector to the battery terminal post, or the removal of the terminal connector from the battery terminal post, by the automobile technician or the automobile owner, without the need for tools.

The battery terminal connector 10 of the present invention is designed for securement to the battery terminal post of a conventional electrical storage battery (not shown). In addition to the conventional body portion 12, the battery terminal connector 10 includes a generally circular opening 14, within and defined by that body portion 12. The perimeter of that generally circular opening 14 receives, circumscribes, and ultimately abuts against the battery terminal post of the electrical storage battery.

The right side of the body portion 12 may also include an inner wall 16 and an outer wall 18. Here, as may best be seen in FIGS. 3, 5, and 7, the inner wall 16 is adjacent and generally parallel to the outer wall 18. Typically, the inner wall 16, the outer wall 18, and the remaining components of the battery terminal connector 10 are formed from a single, stamped piece of copper, copper alloy, or of any other suitable conductive metal or metal alloy. This single, stamped piece of copper is folded to create the body portion 12.

The inner wall 16 and the outer wall 18 may each include a slot 20 and 22, respectively. The slots 20 and 22 may have either the same configuration, or different configurations.

However, in the present embodiment, as will be explained below, these slots 20 and 22 will have different configurations.

A generally horizontal bar 24 extends transversely along and through the body portion 12. The slots 20 and 22 are sized to encompass a portion of the generally horizontal bar 24. Particularly, one lateral end 26 of the generally horizontal bar 24 extends through the slots 20 and 22 of the inner 16 and outer walls 18, respectively.

It should be understood that a "generally horizontal bar," for the purposes of this invention, may be like the flat bar 24 shown in FIGS. 3, 4, 5, and 8, or it may take other forms. That generally horizontal bar may also be rotated about 90 degrees from its orientation as shown in the FIGURES; even when turned in this manner, the bar will be flat, and generally horizontal. In addition, the "generally horizontal bar" need not be flat, but may have a square cross-section, or a more pronounced rectangular cross-section.

Attached to this lateral end 26 of the horizontal bar 24 is a head 28. Preferably, this head 28 is generally perpendicular to the horizontal bar 24. In this preferred embodiment, this generally perpendicular head 28 is integrally formed with the horizontal bar 24. As may best be seen in FIG. 1, this generally perpendicular head 28 is positioned adjacent, and can abut against, the outer wall 18 of the body portion 12.

Figure 2:
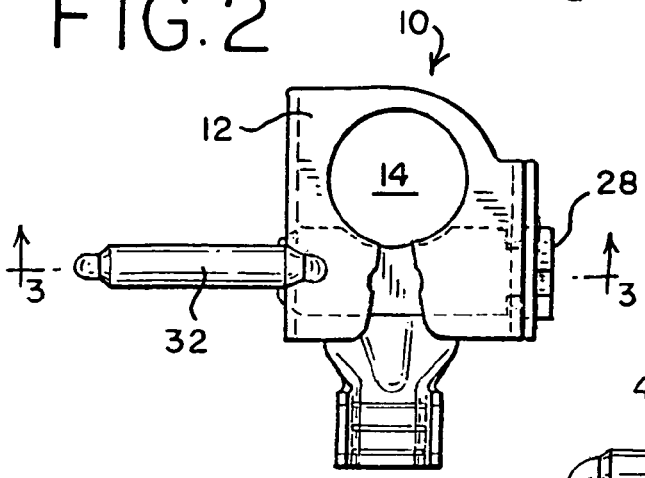
FIG. 2 is a top view of the battery terminal connector of FIG. 1, and with the lever in the 9:00 o'clock position, or in a so-called third position.
Figure 4:
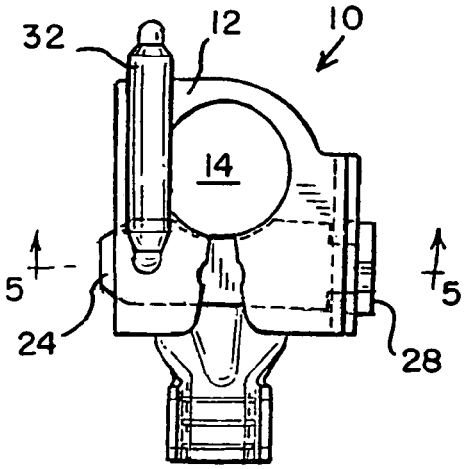
FIG. 4 is top view of the battery terminal connector of FIG. 1, but with the lever in the 12:00 o'clock position, or in a so-called second position.

As may best be seen in FIGS. 2 and 4, the generally perpendicular head 28 may include a sloped top portion 30. As will be explained below, this sloped top portion 30 serves as a ramping surface.

The generally perpendicular head 28 imparts relatively even pressure upon that outer wall 18, and prevents any damage to that outer wall 18.

The battery terminal connector 10 of the invention further includes a movable lever 32 for effecting two-way, opposite lateral movement of the horizontal bar 24.

Using directions based upon the orientation of the battery terminal connector 10 depicted in this FIGS. 2 and 4, as the lever 32 is moved counterclockwise, from the 12:00 o'clock position of FIG. 4, to the 9:00 o'clock position of FIG. 2, the horizontal bar 24 is urged by the lever 32 to the right, within and relative to the battery terminal connector 10. As a result, as may be seen in FIGS. 2 and 3, when the horizontal bar 24 is positioned as shown in those FIGURES, the size of the generally circular opening 14 is at its maximum.

In contrast, when the horizontal bar 24 is moved to the left, within and relative to the battery terminal connector 10, the size of the generally circular opening 14 is gradually decreased, and ultimately minimized. In other words, movement of the horizontal bar 24 to the left causes a progressive closing of the generally circular opening 14.

The movement of this horizontal bar 24 is directly effected by a cam 34 of this lever 32. That cam 34 rotates within either a round- or an oval-shaped orifice 36 that is formed within the horizontal bar 24. As may best be seen in FIG. 8, which depicts an oval orifice 36, the longest dimension of this oval orifice 36 runs transverse to the length of the horizontal bar 24.

Rotation of the lever 32 rotates the cam 34. As the lever 32 is moved in either the clockwise or counterclockwise directions, that cam 34 abuts against the perimeter 38 of the orifice 36. In this way, movement of the lever 32 in both clockwise and counterclockwise directions causes the horizontal bar 24 to move in one of two opposite lateral directions.

Again using directions based upon the orientation of the battery terminal connector 10 as depicted in FIGS. 2 and 4, as the lever 32 is moved clockwise, from the 9:00 o'clock position of FIG. 2, to the 12:00 o'clock position of FIG. 4, the horizontal bar 24 moves to the left, within and relative to the battery terminal connector 10. As a result, as may be seen in a comparison of FIGS. 2 and 4, when the horizontal bar 24 is positioned as shown in FIG. 4, the size of the generally circular opening 14 is reduced, to an opening 14 having an intermediate size.

Figure 6:
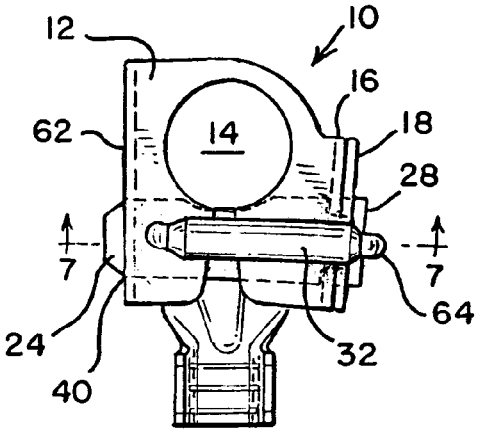
FIG. 6 is a top view of the battery terminal connector of FIG. 1, but with the lever in the 3:00 o'clock position, or a so-called first position.

Finally, as the lever 32 is moved clockwise, from the 12:00 o'clock position of FIG. 4, to the 3:00 o'clock position of FIG. 6, the horizontal bar 24 moves still further to the left, within and relative to the battery terminal connector 10. As a result, as may be seen by a comparison of FIGS. 4 and 6, when the horizontal bar 24 is positioned as shown in FIG. 6, the size of the generally circular opening 14 is reduced still further, to an opening 14 having its minimum size.

The battery terminal connector 10 of the invention permits attachment and securement of that connector 10 onto the battery terminal post, and its removal from that battery terminal post, without the use of tools. The lever 32, in combination with the horizontal bar 24, facilitates this attachment and securement.

Figure 7:
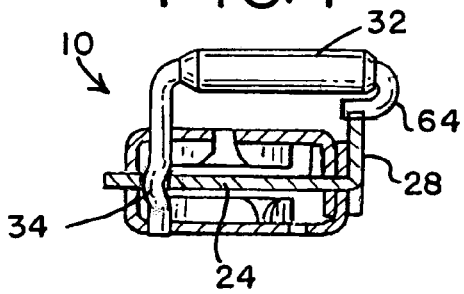
FIG. 7 is a partial sectional view, taken along lines 7—7 of FIG. 6, of the battery terminal connector of FIG. 6.

In summary, the lever 32 is movable into one of three different positions, as shown in the accompanying FIGURES. When the lever 32 is moved into the first position, or the 3:00 o'clock position, as shown in FIGS. 6 and 7, the generally circular opening 14 of the battery terminal connector 10 is reduced to a size such that it tightly grips the battery terminal post. In the embodiment shown in FIGS. 6 and 7, the generally circular opening 14 has an internal diameter of approximately 0.634 inch.

Of course, it will be understood that this dimension, and other dimensions in the description of this preferred embodiment, are exemplary, and in no way limiting. Accordingly, the actual dimensions may be greater or smaller, depending upon the size of the terminal posts of the electrical storage battery.

Figure 5:
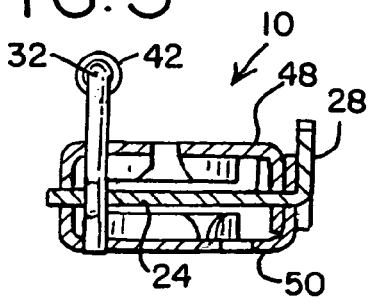
FIG. 5 is a partial sectional view, taken along lines 5—5 of FIG. 4, of the battery terminal connector of FIG. 1.

When the lever 32 is moved clockwise, into the second position, or the 12:00 o'clock position, as shown in FIGS. 4 and 5, the generally circular opening 14 of the battery terminal connector 10 is opened somewhat. The opening 14 is thus spaced a relatively small distance away from the outer perimeter of the battery terminal post. In this second position of FIGS. 4 and 5, the generally circular opening 14 has been increased to an internal diameter of approximately 0.646 inch.

Figure 3:
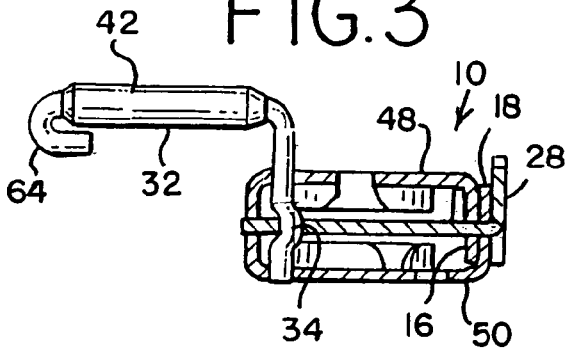
FIG. 3 is a partial sectional view, taken along lines 3—3 of FIG. 2, of the battery terminal connector of FIGS. 1 and 2.

Finally, when the lever 32 is moved still further clockwise, into the third position, or the 9:00 o'clock position, as shown in FIGS. 1, 2, and 3, the generally circular opening 14 of the battery terminal connector 10 is opened to a maximum size, and is as a result spaced a relatively large distance away from the battery terminal post. In the position shown in FIGS. 1, 2, and 3, the generally circular opening 14 has been increased to its maximum size, with an internal diameter of approximately 0.664 inch.

Accordingly, as the lever 32 is moved clockwise, from the 9:00 o'clock position of FIG. 2, to the 12:00 o'clock position of FIG. 4, to the 3:00 o'clock position of FIG. 6, respectively, the generally circular opening 14 gradually decreases in size, from its maximum size to its minimum size.

The body portion 12 has a natural spring tension. Again, when the lever 32 of the battery terminal connector 10 is in the 9:00 o'clock position of FIG. 2, the generally circular opening 14 is at its maximum size. This is because, as will be explained more extensively below, the horizontal bar 24 works against this natural spring tension, and forces the body portion 12 into an expanded or extended configuration. This has the effect of increasing the size of the generally circular opening 14.

In contrast, when the lever 32 of the battery terminal connector 10 is in the 12:00 o'clock position of FIG. 4, the generally circular opening 14 attains an intermediate size. In this position, the natural spring tension of the connector 10 returns its body portion 12 to its ordinary, unstressed state or configuration.

Finally, when the lever 32 of the battery terminal connector 10 is in the 3:00 o'clock position of FIG. 6, the generally circular opening 14 attains its minimum size. In this position, the generally horizontal bar 24 and the perpendicular head 28 cooperate to compress the body portion 12.

As will be explained below, and as may be seen in FIGS. 6 and 7, while in the 3:00 o'clock position, the generally perpendicular head 28 may impart relatively even pressure on the outer wall 18. This prevents damage to the outer wall 18, while at the same time helping to facilitate the reduction in the size of the generally circular opening 14.

As may be seen in FIGS. 3 and 7, the movable lever 32 of the battery terminal connector 10 may include an insulating cover 42. This insulating cover 42 reduces the possibility of shock, and reduces the possibility that electrical current could move from the battery, through the lever 32, and then to an electrical ground. This minimizes the chance that the battery could be discharged through such a ground.

As indicated above, inner wall 16 and outer wall 18 each include a slot 20 and 22, respectively. In this embodiment, as may best be seen in FIGS. 9 and 10, these two slots 20 and 22 have different configurations.

Slot 20 in inner wall 16 has a T-shaped configuration. The "T" of that slot 20 is comprised of a lower leg 44 and an upper leg 46. The lower leg 44 of the slot 20 may be seen in solid lines in FIG. 9, and in dotted lines in FIG. 10.

Figure 9:
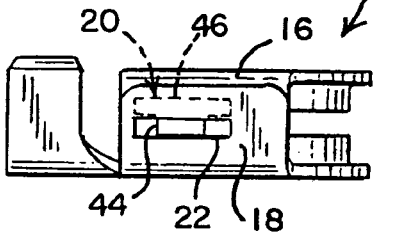
FIG. 9 is a right side view of the battery terminal connector of FIG. 2, in its normal position, but with the horizontal bar and its perpendicular head removed from that connector.

The upper leg 46 of the slot 20 may be seen in dotted lines in FIG. 9.

As may be seen in FIG. 9, slot 22 in outer wall 18 has a narrow, substantially rectangular shape or configuration. The shape and size of slot 22 are similar to the shape and size of the upper leg 46 of T-shaped slot 20.

Figure 10:
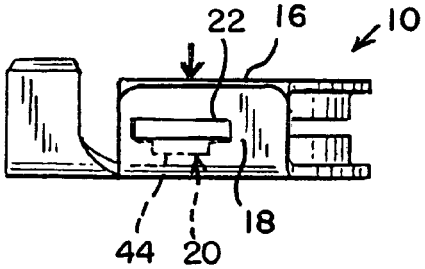
FIG. 10 is another right side view of the battery terminal connector of FIG. 9, but compressed in the direction of the arrow of that FIG. 10, with the result that the inner wall of the connector has been lowered, relative to the outer wall of the connector.

As a result, in FIG. 10, the upper leg 46 of slot 20 is not seen, because it has an identical shape and size as the slot 22 in the outer wall 18, and in that FIG. 10, has been moved to a position where it is aligned with that slot 22.

When the battery terminal connector 10 is being used, the connector 10 is disposed as shown in FIGS. 1 and 9. When the battery terminal connector 10 is in this normal configuration, the lower leg 44 of the T-shaped slot 20 in the inner wall 16 is horizontally aligned with the slot 22 in the outer wall 18.

When the horizontal bar 24 is removed from the connector 10, that connector 10 may be vertically compressed, i.e., compressed in the direction shown in the arrow of FIG. 10. As a result, the inner wall 16 moves downwardly, relative to the outer wall 18. Vertical compression of the connector 10 in this way permits the insertion or the removal of the generally horizontal bar 24 from the connector 10.

Specifically, to compress the connector 10 in this way, the user grasps an upper surface 48 and a lower surface 50 (see FIGS. 3 and 5) of the connector 10, between the forefinger and thumb, at a point near the inner 16 and outer walls 18. Simultaneously, downward pressure is applied to the upper surface 48, and upward pressure is provided on the lower surface 50. This pressure overcomes the natural spring tension of the connector 10, and moves the inner wall 16 downward, relative to the outer wall 18.

As a result of the downward movement of the inner wall 16 relative to the outer wall 18, the upper leg 46 of the T-shaped slot 20 moves into alignment with slot 22. When the upper leg 46 of the T-shaped slot 20 in the inner wall 16 is aligned with the slot 22 of outer wall 18, the horizontal bar 24 may be removed from or inserted into the connector 10.

Referring again to FIG. 8, the horizontal bar 24 includes a pair of notches 52 and 54 adjacent the head 28. The horizontal bar 24 further includes a curved cut-out portion 56. When the horizontal bar 24 is in its normal, fixed positioned within the connector 10, the perimeter of the cut-out 56 coincides the perimeter of the generally circular opening 14. If the bar 24 did not include this cut-out 56, a portion of that bar 24 would interfere with the circular opening 14, and prevent the connector 10 from being secured to the battery terminal post (not shown).

When the connector 10 is released by the user, that connector 10 assumes its normal configuration. Particularly, the connector 10 assumes the position shown in FIGS. 1 and 9, where the lower leg 44 of slot 20 in inner wall 16 is aligned with the slot 22 in the outer wall 18. The notches 52 and 54 are then positioned next to both the inner wall 16, and the lower leg 44 of slot 20.

In this way, when the connector 10 is released to achieve the position of FIG. 9, the lower leg 44 of the slot 20 and the slot 22 cooperatively trap the horizontal bar 24. As a result of this trapping, the end region 26 of the horizontal bar 24 is virtually immovable, relative to walls 16 and 18.

As a result, when rotation of the movable lever 32 causes rightward movement of the horizontal bar 24 within the connector 10, an inboard portion of the notches 52 and 54 presses against the inner wall 16, and in this way moves that inner wall 16 to the right. This in turn extends or expands the body portion 12, and causes a corresponding increase in the size of the generally circular opening 14.

In contrast, when the movable lever 32 causes leftward movement of the horizontal bar 24, an outboard portion of the notches 52 and 54 and the perpendicular head 28 press against the outer wall 18, and thereby move that outer wall 18 to the left. This in turn contracts the body portion 12, and causes a corresponding decrease in the size of the generally circular opening 14.

Referring again to FIG. 8, the horizontal bar 24 includes a pair of ramps 58 and 60. A second outer wall 62 of the connector 10 includes a slot 40. As the bar 24 is moved to the left within the connector 10, these ramps 58 and 60 move through and past this slot 40.

Figure 8:
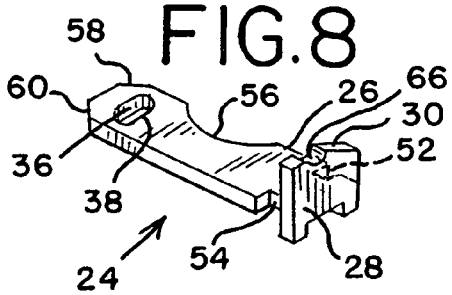
FIG. 8 is a perspective view of a horizontal bar that is one of the components of the embodiment of FIG. 1.
Figure 11:
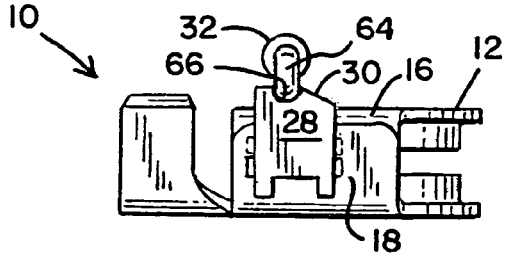
FIG. 11 is a right side view of the battery terminal connector of FIG. 2, including its horizontal bar and perpendicular head, and with the battery terminal connector in its normal position, as depicted in FIG. 9.

As indicated above, and as can best be seen in FIGS. 1, 8, and 11, the generally perpendicular head 28 of the connector 10 includes a sloped top portion 30. This sloped top portion 30 acts as a ramping surface, in the following manner.

As may be seen in FIGS. 1, 3, 7 and 11, the movable lever 32 has a curled end portion 64. As the movable lever 32 is pivoted in a clockwise direction and moved progressively from the 12:00 o'clock position of FIG. 4 to the 3:00 o'clock position of FIG. 6, this curled portion 64 begins to abut against the sloped top portion 30. As rotation from the 12:00 o'clock to the 3:00 o-clock position proceeds, the curled portion 64 is gradually urged upwardly on the sloped top portion 30, and towards indentation 66. At the peak of this sloped top portion 30, the curled end 64 slips off of the sloped top portion 30, and snaps into position within indentation 66. In the position shown in FIGS. 6, 7, and 11, the curled end 64 is in locking interengagement with indentation 66.

When the curled end portion 64 has been snapped into positioned within this indentation 66, inadvertent movement of the movable lever 32 is inhibited. Such inadvertent movement could be caused, for example, by the normal vibration during operation of the motor vehicle in which the connector 10 is installed.

Nevertheless, intentional movement of the curled end portion 64 out of the indentation 66 can be achieved. Particularly, movement of curled end portion 64 out of the indentation 66 arises through the intentional application, by either the car owner or the automobile service technician, of a sufficiently high counterclockwise rotational force on the lever 32.

More specifically, significantly higher force is necessary to move the curled end of the lever 32 out of this indentation 66, as compared to the force necessary to move the lever 32 when it is not positioned within the indentation 66. As a result, the indentation 66 inhibits movement of the lever 32 when that lever is in this 3:00 o'clock position.

In summary, it is clear that the battery terminal connector 10 of the invention includes integral structures, including the lever 32, the cam 34, and the horizontal bar 24, that can facilitate the attachment of the battery terminal connector 10 to the battery terminal post, all without the use of conventional and auxiliary tools, such as box-end wrenches. It is also clear that the battery terminal connector 10 of the invention has integral, internal structures that can facilitate the loosening of the battery terminal connector 10 from the battery terminal post. Finally, it is clear that the battery terminal connector 10 of the invention can be opened to a great extent, i.e., to an extent substantially greater than the minimal extent necessary to remove the connector 10 from the battery terminal post. This facilitates the removal of a corroded terminal connector 10 from a battery terminal post, also without the need for tools.

While the specific embodiments have been illustrated and described, numerous modifications come to mind without significantly departing from the spirit of the invention, and the scope of protection is only limited by the scope of the accompanying Claims.

What is claimed is:

1. A battery terminal connector for securement to the battery terminal post of an electrical storage battery, the battery terminal connector including at least: a body portion, the body portion having at least an outer wall, an inner wall, and a generally circular opening for receiving the battery terminal post; the battery terminal connector further comprising a horizontal bar extending through the body portion, said horizontal bar having a head generally perpendicular to the main axis of the horizontal bar; the horizontal bar extending through both the outer and inner walls; and a movable lever, a portion of that lever extending through the horizontal bar, for effecting two-way linear movement of that horizontal bar, and wherein the lever includes a cam, the cam being contained within the confines of the body portion.

2. The battery terminal connector of claim 1, wherein the generally perpendicular head abuts against the outer wall of the body portion.

3. The battery terminal connector of claim 1, wherein the cam abuts against the perimeter of an orifice in that horizontal bar.

4. The battery terminal connector of claim 1, wherein the lever is movable from a first position in which the generally circular opening of the battery terminal connector tightly grips the battery terminal post, to a second position in which the generally circular opening of the battery terminal connector is spaced a relatively small distance away from the battery terminal post, to a third position in which the battery terminal connector is spaced a relatively greater distance away from the battery terminal post.

5. The battery terminal connector of claim 1, wherein the lever includes an insulating cover.

6. A battery terminal connector, including at least: a body portion; a generally circular opening within that body portion for receiving the battery terminal post; a generally horizontal bar extending transversely along the body portion; a movable lever for effecting two-way linear movement of that generally horizontal bar, wherein the lever includes a cam, the cam being contained within the confines of the body portion, the movable lever being movable in a plane substantially parallel with the horizontal bar, wherein lateral movement of the generally horizontal bar in one direction effects the opening of the generally circular opening, and wherein lateral movement of the generally horizontal bar in a second direction effects the closing of the generally circular opening.

7. The battery terminal connector of claim 6, wherein the cam abuts against the generally horizontal bar to effect that lateral movement.

8. The battery terminal connector of claim 6, wherein the body portion further comprises an outer wall, and wherein the generally horizontal bar further includes a generally perpendicular head that abuts against the outer wall of the body portion.

9. The battery terminal connector of claim 6, wherein the lever is movable from a first position in which the generally circular opening of the battery terminal connector tightly grips a battery terminal post, to a second position in which the generally circular opening of the battery terminal connector is spaced a relatively small distance away from that battery terminal post, to a third position in which the battery terminal connector is spaced a relatively large distance away from that battery terminal post.

10. The battery terminal connector of claim 6, wherein the lever includes an insulating cover.

11. The battery terminal connector of claim 6, wherein the generally perpendicular head is adjacent a lateral end of the generally horizontal bar.

12. The battery terminal connector of claim 11, wherein the generally perpendicular head includes a sloped top portion.

13. The battery terminal connector of claim 12, wherein the sloped top portion serves as a ramping surface.

14. The battery terminal connector of claim 12, wherein the head includes an indentation.

15. The battery terminal connector of claim 14, wherein the lever includes a curled end for locking interengagement with the indentation.

* * * * *